US005499569A

United States Patent [19]

Schuetz

[11] Patent Number: 5,499,569

[45] Date of Patent: Mar. 19, 1996

[54] GAS-OPERATED RIFLE SYSTEM

[75] Inventor: Brian D. Schuetz, Olympia, Wash.

[73] Assignee: Olympic Arms, Inc., Olympia, Wash.

[21] Appl. No.: 420,754

[22] Filed: Apr. 12, 1995

Related U.S. Application Data

[63] Continuation of Ser. No. 887,300, May 22, 1992.

[51] Int. Cl.[6] ..... F41A 3/54

[52] U.S. Cl. ..... 89/197; 42/25

[58] Field of Search ..... 89/194, 195, 196, 89/197; 42/75.02, 75.03, 25

[56] References Cited

U.S. PATENT DOCUMENTS

| | | | |
|---|---|---|---|
| 1,144,285 | 6/1915 | Becker | 89/197 |
| 3,776,095 | 12/1973 | Atchisson | 89/197 |
| 4,358,986 | 11/1982 | Giorgio | 89/185 |

FOREIGN PATENT DOCUMENTS

| | | | |
|---|---|---|---|
| 239977 | 11/1945 | Switzerland | 89/194 |
| 500922 | 2/1939 | United Kingdom | 89/194 |

*Primary Examiner*—Stephen M. Johnson
*Attorney, Agent, or Firm*—Michael J. Caddell

[57] ABSTRACT

An M16 type rifle capable of being fired in automatic or semiautomatic mode is disclosed utilizing a blow-back system with a forcing cone breech and a matching conical bolt face. The blowback bolt assembly of the present invention allows elimination of the troublesome and easily fouled gas operating system of the conventional M16 rifle and further allows the rifle to be chambered for short low-pressure pistol cartridges such as the 45 ACP and the 40 S&W.

3 Claims, 3 Drawing Sheets

GAS-OPERATED RIFLE SYSTEM

CROSS-REFERENCE TO RELATED APPLICATION

This is a continuation application of a copending previously filed application, Ser. No. 07/887,300, filed May 22, 1992, still pending, by Brian D Schuetz, for "GAS OPERATED RIFLE SYSTEM", which prior application is hereby incorporated herein by reference.

BACKGROUND OF THE INVENTION

The present invention is directed to the field of firearms and more particularly involves an automatic/semi-automatic hand-held rifle of the type exemplified by the U.S. military M16.

The M-16 automatic rifle and the AR15 semi-automatic rifle have been the standard issue weapons of the U.S. military and civilian police departments for decades. The rifle design was originated by E. M. Stoner and developed by Fairchild Engine and Airplane Company in the 1950's. Modified versions of the M16 designated as the M16A1 and M16A2 are currently in use by armed forces in the U.S. and throughout the world. A civilian semi-automatic version of the M16 designated as the AR15 is sold to civilians by Olympic Arms of Olympia, Wash. When used herein, the phrase "M16" is intended to include all versions of the M16 and AR15 previously and currently being produced.

One of the basic patents on gas-operated firearms was that granted to Browning in 1938, U.S. Pat. No. 2,116,141, which was a divisional application of U.S. Pat. No. 2,093,705. These patents disclose a piston tube assembly for disengaging the barrel from the casing of the gun.

U.S. Pat. No. 2,951,424 issued to E. M. Stoner on Sep. 6, 1960, discloses the M16 bolt and bolt carrier system and the gas operation thereof. This patent discloses a rifle utilizing a gas tube that extends from gas ports in the barrel, back into the receiver of the rifle and into a gas tube pocket or "key" attached to the bolt carrier.

U.S. Pat. No. 3,198,076 to E. M. Stoner, issued Aug. 3, 1965, discloses a gas operated, magazine-fed rifle that can be readily converted to a belt-fed machine gun by inverting the barrel assembly.

U.S. Pat. No. 3,675,534, issued to P. C. Beretta on Jul. 11, 1972, discloses a gas-operated automatic rifle having a piston and stem inside a gas tube with the stem fixedly attached to the bolt carrier.

U.S. Pat. No. 4,358,986, issued to C. Giorgio on Nov. 16, 1982, discloses a gas-operated automatic rifle having a stationary piston and a segmented movable gas cylinder/operating rod assembly including a biasing spring.

U.S. Pat. No. 3,618,457, issued to A. Miller on Nov. 9, 1971, discloses a gas-operated rifle utilizing a gas-operated piston and rod assembly with the piston rod telescopically mounted over a stationary guide rod and being spring-biased.

U.S. Pat. No. 4,765,224, issued Aug. 23, 1988, to M. Morris discloses a modified M16 type of rifle utilizing an extended gas tube receiver on the bolt carrier which maintains telescopic engagement with the gas tube at all times during the firing cycle.

U.S. Pat. No. 4,475,438 to L. Sullivan, issued on Oct. 9, 1984, discloses an open-bolt gas-operated rifle with a short-stroke piston that kicks open the bolt carrier against a biasing spring, using a short-stroke piston movement.

While the aforementioned gas-operated rifles all disclose various means of actuating a bolt in an automatic or semi-automatic rifle, none of these teaches a design for an M16 type of rifle that allows the rifle to be chambered for short pistol-type cartridges such as the 40 S&W cartridge and the 45 caliber ACP cartridge. There is insufficient gas generated in these short "fat" pistol cartridges to fully activate the bolt carriers in these designs. For example, the conventional M16 rifle is normally chambered for the 5.56 NATO rifle cartridge which generates gas pressures in the range of 52,000 CUP. This rifle utilizes a gas port passing through the wall of the barrel which transits pressurized gases from the firing of the cartridge back to the bolt carrier. The pressurized gases impinge a gas key on the bolt carrier to drive the bolt carrier and bolt backward in the receiver.

The cycling of the bolt carrier assembly in the conventional M16 rifle depends entirely upon the gas pressures generated in the gas-tube assembly, which gases impact the bolt carrier and drive it backward. This gas pressure also communicates through gas vents in the bolt carrier to a piston on the bolt to provide movement of the bolt in the carrier.

The disadvantage of the M16 rifle is its inability to handle relatively low-pressure cartridges such as those used with the short, fat pistol cartridges including the .45 ACP, the .40 S&W, and the 9 mm. The pressures generated in these short cartridges are in the range of 40,000 CUP as contrasted with the 50,000–55,000 CUP generated with most rifle cartridges. These low pressures in the pistol cartridges are insufficient to cycle the conventional M16 bolt assembly acting through the gas tube/gas key assembly of the M16. One reason these pressures are insufficient to cycle the M16 bolt assembly is because of the large energy requirement in moving the bolt backward in the receiver while simultaneously rotating the bolt out of locking engagement in the chamber, extracting the cartridge, and ejecting it. While simultaneously performing all of these functions, the gas pressure must also move a weighted rod called a buffer and compress a buffer spring telescopically located in the rifle buttstock.

Another disadvantage of the gas-operated M16 currently being manufactured is the fouling of the gas ports in the bolt carrier and the gas rings on the piston end of the bolt. A large amount of residue from the buring powder collects in these small and rather tortured ports and grooves. Also, dirt and moisture from the atmosphere are mixed with the gas from the burning powder in the gas system and residuals are formed in the ports and in the gas rings on the bolt, which eventually clog and jam the weapon. Gas rings on the bolt, which eventually clog and jam the weapon. Gas exiting the ports from the bolt also mix with dirt and moisture and cause deposits between the bolt, the chamber, and the receiver, thereby interfering with proper operation of the bolt and bolt carrier in the receiver.

One method of overcoming these difficulties in chambering the M16 rifle for short, low-pressure pistol cartridges is to utilize a blow-back design instead of the gas tube/gas key system used in the conventional M16 rifle. A blow-back system differs from the M16 system in that the bolt is never locked-up in the breech and the bolt cycle is achieved by gas pressure in the chamber directly blowing back the cartridge against the bolt face to cycle the bolt back against the buffer assembly to accomplish spent cartridge ejection and new cartridge loading.

SUMMARY OF THE INVENTION

The present invention overcomes the disadvantages of the above-described prior art M16 rifles by providing a blowback actuated automatic/semi-automatic rifle of the M16 type which is fully capable of chambering low-pressure, short pistol cartridges without jamming or misfiring.

DESCRIPTION OF THE PREFERRED EMBODIMENTS

Figure 1:
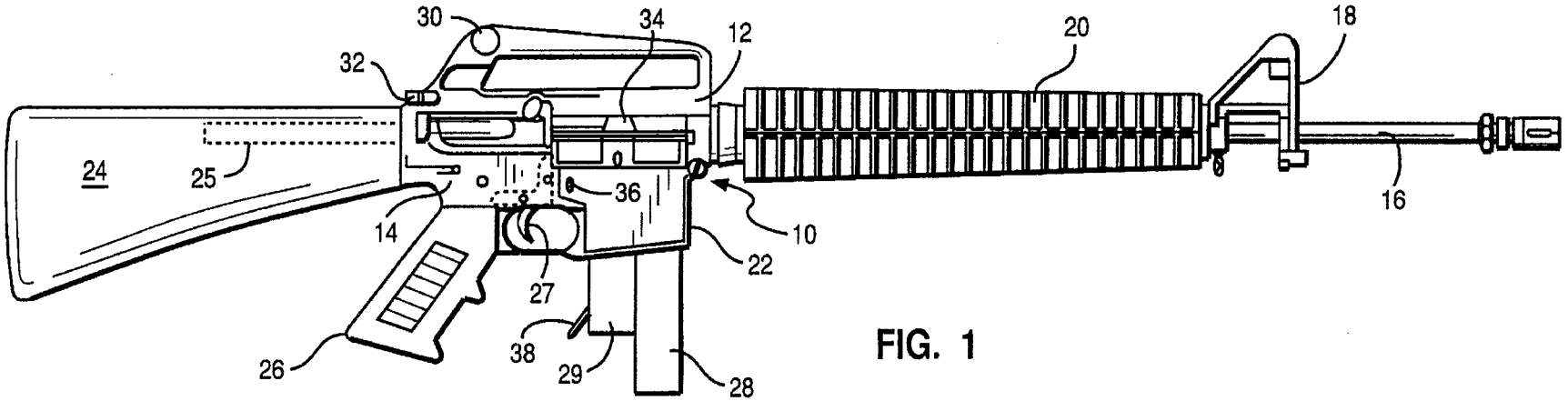
FIG. 1 is a side view of the M16 rifle of the present invention.

Referring now to FIG. 1, which is a side view of an M16 type rifle manufactured according to the present invention, a rifle 10 consists of an upper receiver 12 pivotally attached to a lower receiver 14 and having a barrel 16 threadedly engaged in the upper receiver 12. Barrel 16 has a front sight assembly 18 securedly attached thereto and is enclosed by a handguard assembly 20.

The upper and lower receivers 12 and 14 respectively, are braced by the buttstock assembly 24, which is threadedly attached to the lower receiver 14 and contains a conventional M16 buffer assembly therein as shown in schematic at 25. A handgrip 26 is attached to the lower receiver directly behind the trigger assembly which is shown in partial schematic format. A removable magazine 28 and magazine adapter 29 fit in the magazine well of lower receiver 14 and provide a cartridge feeding assembly. A rear sight assembly 30 is adjustably mounted in upper receiver 12. A charging handle 32 is slidably located in upper receiver 12 and also slidably engages bolt assembly 34.

Figure 2:
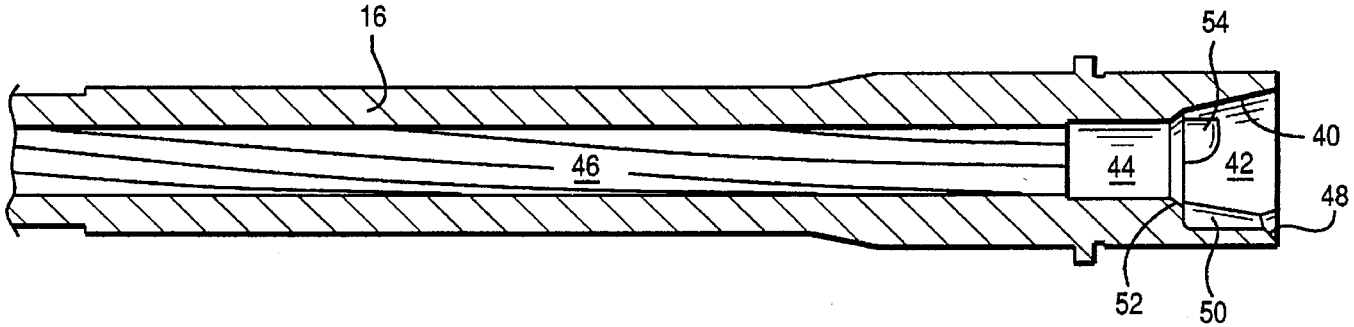

Referring now to FIG. 2, a schematic cross-sectional side view of the barrel 16 of the present invention is illustrated. Barrel 16 has formed therein a rifled bore 46, communicating with a cartridge chamber 44 adapted to receive a short wide pistol cartridge such as the 45 ACP caliber, 9 mm, or 40 S&W. At the end of barrel 16 communicating with chamber 44 is the breech 42 comprising a forcing cone 40 and a transition cone 52 lying between forcing cone 40 and chamber 44. Forcing cone 40 comprises a frusticonical section of breech 42 formed in the breech end of barrel 16. Forcing cone 40 has formed therein a feed ramp 48 extending upward from the bottom end of the breech and intersecting a bolt relief area 50 which extends forward into the forcing cone to transition cone 52.

Figure 3:
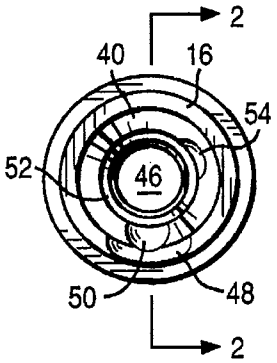
FIGS. 2 and 3 are, respectively, a cross-sectional side view and an end view of the barrel from the rifle of FIG. 1.

FIG. 3 is an end view of the schematically represented barrel 16 indicating the relationship of the feed ramp 48 and the bolt relief 50 formed in the surface of forcing cone 40. Likewise, visible in FIG. 3 is another relief 54 formed in the upper right hand portion of forcing cone 40 and adapted as an extractor relief area to allow operation of the cartridge extractor when the bolt is in full battery in breech 42.

Figure 4:
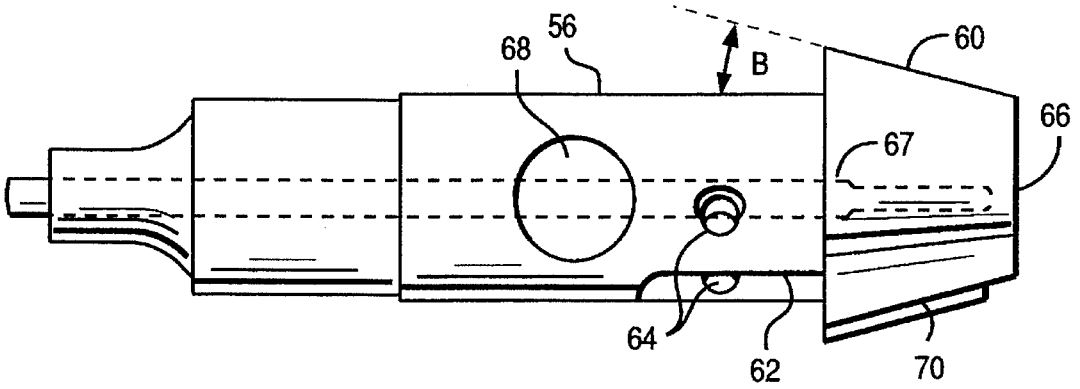
FIG. 4 is a side view of the bolt of the rifle of FIG. 1.

FIG. 4 illustrates a side view of the bolt member 56 in one preferred embodiment of the present invention. In FIG. 4 bolt 56 comprises a conical mating surface 60 adapted for complimentary engagement with forcing cone 40 of the breech end 42 of barrel 16. The angle B of conical end 60 is identical to or very close to the angle of the conical surface of forcing cone 40. The bolt body 56 has a cartridge engaging face 66, and an extractor groove 70 formed in the end thereof. An extractor groove 62 extends rearwardly from bolt conical surface 60 for receiving a spring loaded extractor member (not shown). A bore passage is formed through bolt body 56 intersecting extractor groove 62 which results in a pair of transversely opposed holes 64 for receiving a mounting pin (not shown) to mount the extractor in bolt body 56. The extractor used in the bolt assembly of the present invention is the conventional M16 type extractor and is pinned at 64 with a compression spring between the extractor and the bolt body to maintain the extractor head engaged over a cartridge rim and resiliently biased radially inward against the cartridge face. The operation of the extraction means in bolt 56 is similar to that of a conventional M16 and no further definition is therefore required. A conventional M16 firing pin 67 is shown in schematic representation going down the centerline of bolt 56.

A circular area 68 represents the conventional cam pin bore passage formed in bolt body 56 which, because of the blow-back type of operation of the present invention, is not needed for proper operation of the rifle system. The bore passage 68 is referenced in the drawing to indicate the location of the conventional cam pin bore passage in a conventional lock-up type bolt system of the standard M16 rifle. In the conventional rifle system the cam pin system is necessary in order to rotate the bolt in and out of the lock-up position in the breech by camming against a curved cam of the straight blow-back of the bolt assembly in the present invention, it is unnecessary to rotate the bolt and therefore no camming action is required with respect to the bolt and the bolt carrier. In fact, it is preferable that the bolt and bolt carrier be connected together in a permanent relationship to prevent relative movement therebetween.

Figure 5:
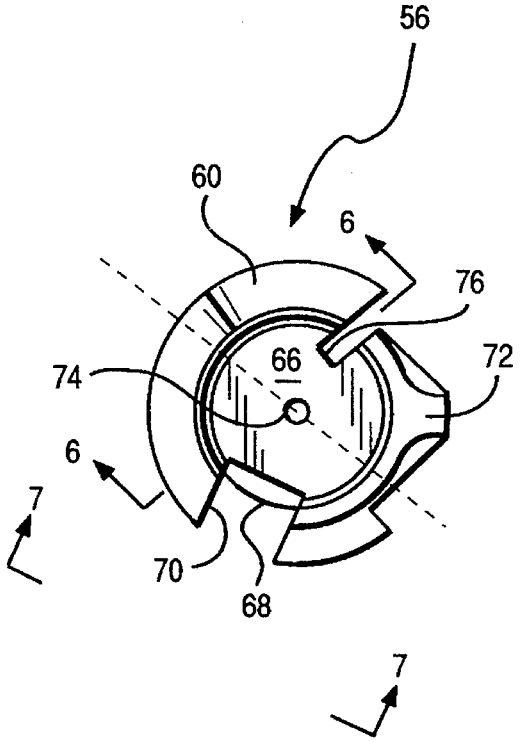
FIG. 5 is an end view of the bolt.

FIG. 5 represents an axial end view of the bolt body of FIG. 4 taken from the right side of FIG. 4. In FIG. 5 bolt body 56 is shown having the conical surface 60 formed on the end thereof and in which is formed the ejector groove 76 cut on an incline radially inward into the bolt head. The bolt also has a recessed cartridge engagement face 66 having a central bore passage 74 formed therethrough for the provision of a conventional M16 firing pin to extend through bolt face 66. FIG. 5 also illustrates the extractor groove 70 formed in the wall of the bolt in which is located a conventional spring loaded extractor pin 68 for resilient engagement with a rim of a cartridge case and operable in a conventional manner known to those skilled in the art of M16 operation. Also shown in FIG. 5 is a cartridge feed shoulder 72 formed at the bottom end of the bolt by machining away recessed areas on each side thereof from the bolt face. Shoulder 72 has a flat vertical face rather than a conical surface, which can be seen more clearly in the view of FIG. 7. Cartridge feed shoulder 72 is arranged to engage a live or unfired cartridge round in the rifle magazine which entends upward into the lower receiver of the rifle. As the bolt 56 cycles forward in the lower receiver the shoulder 72 engages an unfired cartridge in the magazine and carries it forward through the breech 42 and into snug fitting engagement in chamber 44. The provision of bolt relief 50 is intended to allow shoulder 72 to move into breech 42 without conflicting engagement with the wall of the breech chamber 42.

Figure 6:
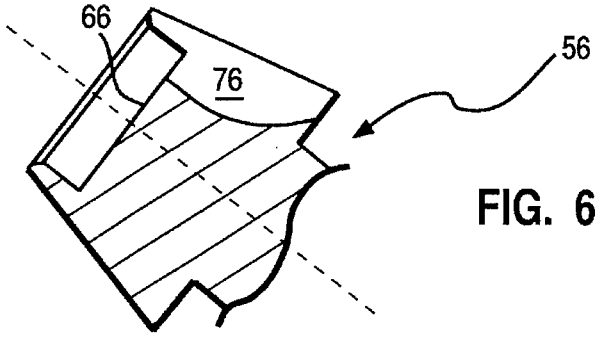
FIG. 6 is a partial cross-sectional view of the bolt taken at line 6—6 of FIG. 5.

FIG. 6 is a partial cross-sectional view of the breech end of bolt 56 illustrating the recessed nature of cartridge engagement face 66 and further illustrating the ramped nature of ejector groove 76 formed in the wall of the conical portion of bolt 56.

Figure 7:
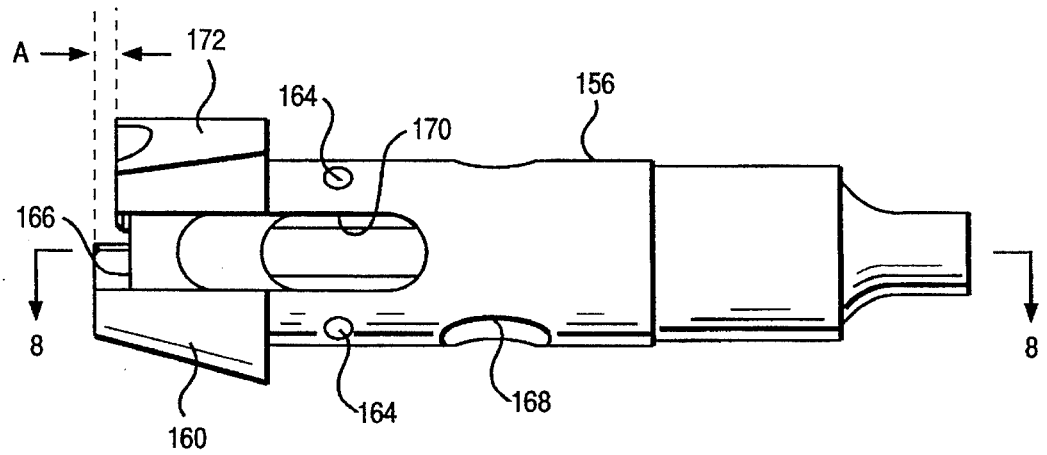
FIG. 7 is a side view of a second embodiment of the bolt.

Referring now to FIG. 7, a second embodiment of the bolt body 56 of FIG. 4 is shown in side view and designated as 156. Bolt member 156 has conventional cam pin bore 168 formed there-through indicating that bolt 156 can be manufactured from a conventional M16 bolt with a minimum amount of machining and modification. Likewise, bolt 156 has pin bore holes 164 formed through the wall and intersecting groove 170 for securing a conventional extractor pin (not shown) in the bolt. A conical surface 160 is formed on the breech end of the bolt for engagement in tight-fitting engagement in the forcing cone 40 of the breech chamber 42. Bolt 156 also has a cartridge feed shoulder 172 extending downward from the bottom thereof for removing live rounds from the rifle magazine and carrying them forward into the rifle chamber. Likewise, a recessed cartridge face 166 is formed in the face of bolt 156. The main difference between bolt 156 and bolt 56 is the provision of a stepped or relief portion cut into the lower half of bolt 156 a distance designated at "A" shown in FIG. 7. This undercut or relief portion "A" is provided to allow easier feeding of a particular cartridge, i.e. the 45 ACP caliber cartridge from the magazine upward into the cartridge recessed area 166 of the bolt. The remainder of bolt 156 is identical to bolt 56 and functions identically to that structure.

Figure 8:
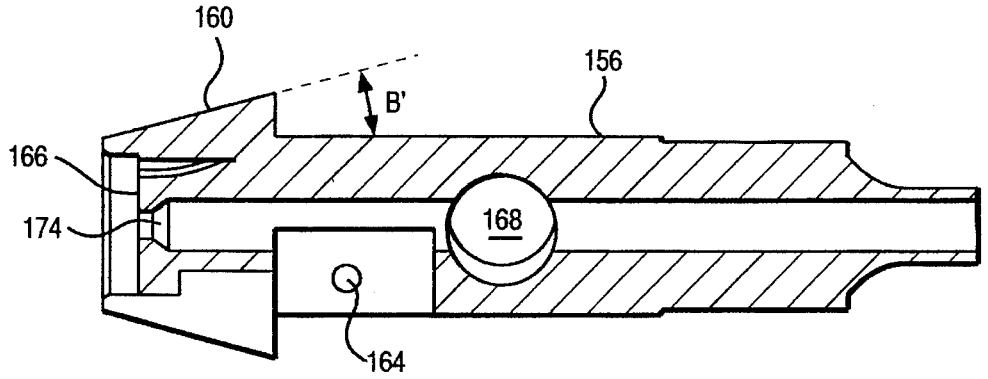
FIG. 8 is a cross-sectional view of the bolt of FIG. 7 taken at line 8—8 of FIG. 7.

FIG. 8 is a partial cross-sectional side view of the bolt 156 of FIG. 7 taken at line 8—8 thereof. This cross-sectional side view illustrates the relationship of the conical face 160, the recessed face 166, and the firing pin passage 174 of the bolt of FIG. 7.

Figure 9:
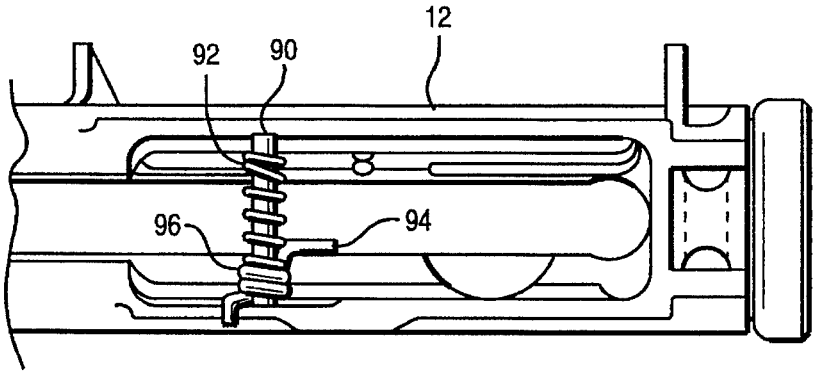
FIG. 9 is a partial cross-sectional schematic representation of the rifle looking upward at the ejector mechanism of the upper receiver.

Ejection of the spent pistol cartridge from the bolt assembly area of the receiver cannot be accomplished with a conventional ejector pin normally utilized in the bolt face of the M16 rifle due to the extremely short length of the pistol cartridge and the extremely short travel of the conventional M16 bolt-mounted ejector pin. The relatively short travel distance of the ejector pin in the conventional M16 is insufficient to rotate the short pistol cartridge completely out of the rifle receiver, therefore the present invention utilizes a unique ejector system mounted in the upper receiver rather than in the bolt. FIG. 9 is a cross-sectional view of the upper receiver of the rifle 10 looking upward from directly below the upper receiver. A transverse rod 90 extends across upper receiver 12 and is secured in the opposite sides thereof. Concentric biasing springs 92 and 96 are mounted around rod 90 to apply biasing forces against an ejector spring rod 94 which extends forwardly of pin 90 and engages in the ejector groove 76 of bolt 56. When bolt 56 is engaged in breech 42, rod 94 does not extend past the face of bolt 56.

A magazine adapter 29, comprising an elongated bar, is located in magazine housing 22 and occupies approximately the rear one-third to one-half of the front-to-back depth of the housing. Since the lower receiver 14 is a conventional M16 receiver unit, adapter 29 will preferably have the identical or similar configuration to the rear portion of a conventional M16 magazine, including the same or similar width, and the same indentations for engaging the conventional magazine catch and release button 36. In addition, adapter 29 has a magazine release lever 29 of its own for engaging and releasing the narrowed pistol cartridge magazine 28.

Pistol cartridge magazine 28 can have the exterior sides and front edge shaped similar to the front portion of a conventional M16 magazine to facilitate ease of use in the conventional receiver 14, or, a standard extended magazine from a different type of firearm such as a Thompson .45 SMG or an UZI 9 mm carbine may be used. In either case, magazine 28 has a release catch formed in the rear wall thereof for engagement by lever 38 of adapter 29.

As previously mentioned, ejector mounting pin 90 extends across the upper receiver in a position to block entry of a conventional 5.56 mm cartridge into the chamber of the rifle. This is preferably located directly above adapter 29 and therefore necessitates the adapter extending a slightly lesser distance upward into the lower receiver when latched into place by magazine catch/release knob 36. This is achieved by making the adapter shorter at the top than a conventional M16 magazine, above the magazine catch notch on the adapter. This arrangement, in conjunction with the ejector mounting pin, provides the advantageous feature of preventing an accidental loading of a conventional M16 5.56 mm magazine into the rifle.

In addition to the advantage described above, the magazine adapter/magazine arrangement provides an even further advantage in that it creates an ambidextrous magazine release system as opposed to the unidextrous magazine release of the conventional M16 rifle. The conventional M16 magazine release consists of the single release button 36 on the right hand side of the lower receiver 14. It must be pushed in from the right side by the rifle operator's right hand, it cannot be reached in a practical manner by the left hand. This is a serious drawback and is particularly disadvantageous in those situations where quick loading of a full magazine is essential, such as in the heat of combat or police action.

With the present invention, once magazine adapter 29 is securely latched in place in the magazine housing 22 of the conventional M16 lower receiver, there will be no need for constantly actuating magazine release button 36. Instead, the new pistol cartridge magazine 28 is released by squeezing lever 38 downward on adapter 29, releasing magazine 28 from the rifle. This can be accomplished equally easily with either the right hand or left hand of the rifle operator, resulting in a truly ambidextrous magazine release.

In operation, when bolt 56 cycles backwards in response to gas generated by the firing of the cartridge in chamber 44, rod 94 remains stationary in groove 76. As bolt 56 continues to move backwards in relation to rod 94, the bolt will carry the cartridge secured by extractor 68 in the face of the bolt into contact with the forwardly extending and stationary rod 94. As the bolt continues backward movement in the receiver the cartridge will be forced against rod 94 and rod 94 will serve to push the cartridge out of engagement with bolt face 66 and extractor 68 and rotate the fired cartridge case outward through the ejection port of the upper receiver. This combination of rotational and axial force imparted on the fired cartridge case results in a springing outward of extractor 68 until the cartridge is free of the bolt face. Rod 94 then pushes the cartridge completely out of the ejection port of the rifle and the bolt finishes its rearward movement and is returned forward by the action of the conventional buffer assembly (not shown) located in the buttstock 24 of rifle 10.

In addition to the ejection function provided by the ejector assembly 90 and 94, rod 90 also serves a second independent function, that being the prevention of loading of a conventional M16 magazine into the magazine well of lower receiver 14. Only the short narrow magazine 28 can be inserted forward of rod 90 because of the placement of the rod in the receiver. Thus, the rifle operator cannot accidentally load a conventional magazine containing the 5.56 mm rifle cartridge of the standard M16 into the rifle of this invention.

Thus, in typical operation the present embodiment of the M16 rifle eliminates the complexities of the gas tube operation of the standard M16 system. The present invention thus eliminates the problems of plugged gas ports and gas passages as well as eliminating the need for rotational camming movements of the bolt with respect to the breech and the bolt carrier. Also, the present invention eliminates the need for friction-inducing piston rings located between the bolt and the bolt carrier for utilizing the gas operation of the gas tube assembly. By eliminating the entire gas operating system of the conventional M16, the present invention allows the use of a short, wide, low-pressure pistol cartridge such as the 45 ACP and the 40 S&W in the conventional M16 receiver. This is achieved by the use of the blow-back bolt system described in FIGS. 2–9, which system utilizes instead of the locking lugs of the conventional M16 a matching forcing cone breech and conical bolt face arrangement with a blow-back system depending only upon gas pressures formed in the chamber by the firing of the cartridge. Thus, the bolt/carrier bolt assembly of the rifle of this invention will cycle forward and the cartridge feed shoulder 72 of the bolt will engage a live round (unfired cartridge) in the magazine 28 and will move the short fat cartridge into the feed ramp 48 and through forcing cone 40 into snug fitting engagement in chamber 44. Upon reaching the forwardmost position the bolt 56 will have the conical section 60 tightly engaged in forcing cone 40 preventing any leakage of gas thereby. The inertia of the bolt and the bolt carrier will seal the chamber as will the spring tension provided by the conventional buffer assembly of the M16 rifle which is located in buttstock 24. Thus, the combination of the resilient biasing force of the buffer spring, plus the inertia of the buffer and bolt and bolt carrier, all serve to hold the bolt in position in breech 40 during firing of the pistol cartridge.

The firing of the relatively low-pressure pistol cartridge results in an immediate movement of the slug from the cartridge down bore 46 and a somewhat subsequent reaction backward in response to the gas pressure and the recoil against bolt 56. The continued backward reaction of the cartridge against the bolt face will serve to drive the bolt backward against the inertia thereof as well as the inertia of the buffer and the resiliency of the buffer spring until the bolt has moved back sufficiently to extract the fired cartridge from the chamber 44. Continued movement backward of the bolt will cause the cartridge face to engage the external ejector rod 94 extending up through ejector rod groove 72 of the bolt which then serves to drive the cartridge rim out from below the lip of the extractor 68 and further rotate the fired cartridge out of the interior of the rifle through the ejection port.

In one embodiment of the present invention represented by the bolt structure found in FIGS. 4–6, the bolt face has a relatively constant configuration. This bolt structure was found to be advantageous for the particular calibers of 40 S&W and 9 mm . The configuration of the bolt illustrated in FIGS. 7 and 8, wherein a portion "A" of the bolt face has been relieved along the bottom periphery is particularly advantageous in the 45 ACP chambering. The 45 ACP cartridge is slightly more difficult to handle than the 40 S&W and the 9 mm and this relief of the bolt face indicated at "A" allows the 45 ACP cartridge to be fed from the magazine readily into the bolt face area 166.

The particular materials found to be advantageous for manufacturing the various bolt assemblies of the various embodiments of the present invention preferably are of the hard metallic types such as steel or stainless steel. In one preferred embodiment, the bolt assemblies 56 and 156 were manufactured from conventional M16 type bolts by machining off the standard locking lugs of the conventional bolts and forming the polished conical bolt end 60 or 160 on the conventional bolt. Likewise, the locking lugs in the breech of the conventional M16 may be machined out, forming a complimentary forcing cone, with the various reliefs for the extractor and the loading ramp also being machined into the remaining metal. The remaining M16 parts such as the bolt carrier and buffer assembly remain unchanged. In the embodiment utilizing conventional M16 bolt structure having the modified conical end formed thereon, the bolt member 56, 156 was permanently attached in the proper vertical orientation inside the conventional M16 bolt carrier by means such as pinning, welding, or machine screws. In the preferred embodiment of the present invention the conical angle indicated at "B" of the figures was preferably formed in the range of about 5° to 30° and most preferably in the range of about 10° to 15°. In one preferred embodiment for the 45 ACP angle "B" was formed at about 10°, and in another preferred embodiment for the 40 S&W and 9 mm calibers angle "B" was formed at about 15°. Also, in the embodiment of FIGS. 7 and 8 for the 45 ACP caliber, dimension "A" was preferably in the range of about 1/16 inch.

Thus, the present invention discloses a modified M16 rifle which eliminates the conventional M16 gas tube operation and all the inherent flaws and defects of the gas operation, including the fouling and plugging of the gas ports, by providing a modified conical bolt and forcing cone breech assembly which allows a blow-back operation to be utilized and provides an M16 type automatic or semi-automatic rifle to be chambered in the low-pressure, short, wide cartridges such as the 45 ACP and 40 S&W.

Although a specific preferred embodiment of the present invention has been described in the detailed description above, the description is not intended to limit the invention to the particular forms or embodiments disclosed therein since they are to be recognized as illustrative rather than restrictive and it would be obvious to those skilled in the art that the invention is not so limited. For example, whereas the invention is described with respect to the short, wide, low-pressure pistol cartridges such as the 45 ACP and the 40 S&W, it is clear that this invention might also be modified to cover other cartridges such as the 10 mm and the 44 magnum. Thus, the invention is declared to cover all changes and modifications of the specific example of the invention herein disclosed for the purposes of illustration which do not constitute departure from the spirit and scope of the invention.

The embodiments of the invention in which an exclusive property or privilege is claimed are defined as follows:

1. A handheld rifle capable of firing short wide pistol cartridges, said rifle comprising:

a lower receiver having a magazine housing, a trigger and hammer assembly, a handgrip, a buffer assembly, and a buttstock assembly;

an upper receiver pivotally connected to said lower receiver;

a barrel attached to said upper receiver, said barrel having a rifled bore, a cartridge chamber adapted to receive a short wide pistol cartridge to be fired therein, said chamber communicating with said bore, and a breech chamber having a forcing cone formed therein;

a non-rotating bolt assembly slidably located in said upper receiver in a forwardly biased relationship by said buffer assembly and axially aligned with said barrel, and having a conical end adapted for close-fitting, non-locking sealing engagement in said forcing cone;

an extractor located resiliently in said bolt assembly and arranged to grip the rim of a cartridge in said cartridge chamber;

a firing pin slidably located in said bolt assembly and arranged to be activated by said trigger and hammer assembly to fire a cartridge located in said chamber; and an ejector assembly located in said upper receiver and arranged to eject cartridges from said bolt assembly upon rearwardly movement of said bolt assembly;

wherein said bolt assembly conical end has a recessed bolt face adapted to receive a short wide pistol cartridge therein, an ejector groove extending at least partially therethrough, and a cartridge feed shoulder extending. downwardly therefrom.

2. The rifle of claim 1 wherein said ejector assembly comprises an ejector rod resiliently mounted on a transverse pin extending across said upper receiver, said ejector rod projecting into said ejector groove.

3. The rifle of claim 1 wherein said forcing cone includes a feed ramp formed in the lower portion thereof, and a relief groove formed therein, above said feed ramp.

* * * * *